US011512547B2

(12) United States Patent
Chamarthy et al.

(10) Patent No.: US 11,512,547 B2
(45) Date of Patent: Nov. 29, 2022

(54) DUMP BAILERS

(71) Applicant: Halliburton Energy Services, Inc., Houston, TX (US)

(72) Inventors: Pramod Chamarthy, Frisco, TX (US); Qian Wu, Austin, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/611,764

(22) PCT Filed: Dec. 14, 2018

(86) PCT No.: PCT/US2018/065680

§ 371 (c)(1),
(2) Date: Nov. 7, 2019

(87) PCT Pub. No.: WO2020/122934

PCT Pub. Date: Jun. 18, 2020

(65) Prior Publication Data

US 2021/0332657 A1 Oct. 28, 2021

(51) Int. Cl.
*E21B 27/02* (2006.01)
*E21B 33/13* (2006.01)

(52) U.S. Cl.
CPC ..... *E21B 27/02* (2013.01); *E21B 33/13* (2013.01)

(58) Field of Classification Search
CPC ..... E21B 27/02
See application file for complete search history.

(56) References Cited

U.S. PATENT DOCUMENTS 1,687,161 A * 10/1928 Johnson ..... E21B 27/02 294/68.22
2,141,179 A 12/1938 Ennis
2,398,752 A 4/1946 Matson
2,769,498 A * 11/1956 Huber ..... E21B 27/02 166/66.4

(Continued)

FOREIGN PATENT DOCUMENTS

CN 202263595 U 6/2012
EP 1653043 A1 * 5/2006 ..... E21B 27/02

OTHER PUBLICATIONS

International Search Report issued in PCT/US2018/065680, dated Aug. 26, 2019.

(Continued)

*Primary Examiner* — Blake Michener
(74) *Attorney, Agent, or Firm* — John Wustenberg; Parker Justiss, P.C.

(57) ABSTRACT

A dump bailer includes a bailer body defining an interior space for conveying cement slurry downhole. A dump release mechanism is operatively connected to the bailer body for releasing cement slurry from the interior space. An agitator is operatively connected to the bailer body for agitating cement slurry in the interior space. In general, in another aspect, the disclosed embodiments relate to a method of delivering cement slurry to a downhole position in a well bore. The method includes a running a bailer downhole in a well bore, wherein cement slurry is housed within the bailer. The method includes agitating the cement slurry within the bailer and releasing the cement slurry from the bailer into the well bore.

12 Claims, 3 Drawing Sheets

(56) References Cited

U.S. PATENT DOCUMENTS

| | | | | |
|---|---|---|---|---|
| 3,379,251 | A | 4/1968 | Bohn | |
| 4,696,343 | A | 9/1987 | Anderson et al. | |
| 4,739,829 | A | 4/1988 | Brunner | |
| 5,469,918 | A | 11/1995 | Haberman | |
| 5,533,570 | A * | 7/1996 | Streich | E21B 27/02 166/153 |
| 6,170,574 | B1 | 1/2001 | Jones | |
| 7,063,141 | B2 | 6/2006 | Masak | |
| 7,287,591 | B2 | 10/2007 | Campbell | |
| 7,624,803 | B2 * | 12/2009 | Daccord | E21B 27/02 166/305.1 |
| 8,113,282 | B2 | 2/2012 | Picou | |
| 9,038,714 | B2 | 5/2015 | Colon et al. | |
| 9,334,704 | B2 | 5/2016 | Mineo et al. | |
| 2010/0122814 | A1 * | 5/2010 | Picou | E21B 27/02 166/278 |
| 2010/0155054 | A1 | 6/2010 | Innes et al. | |
| 2011/0155390 | A1 | 6/2011 | Lannom et al. | |
| 2014/0158358 | A1 | 6/2014 | Pantano | |
| 2014/0318782 | A1 | 10/2014 | Bourque | |
| 2014/0326465 | A1 | 11/2014 | Carisella | |
| 2015/0240583 | A1 * | 8/2015 | Mineo | E21B 34/06 166/311 |
| 2015/0292288 | A1 | 10/2015 | Kasperski et al. | |

OTHER PUBLICATIONS

D. Lootens, P. Hebraud, E. Lecolierand H. Van Damme; "Gelation, Shear-Thinning and Shear-Thickening in Cement Slurries"; Oil & Gas Science and Technology-Rev. IFP, vol. 59 (2004), No. 1; pp. 31-40.

* cited by examiner

DUMP BAILERS

CROSS REFERENCE TO RELATED APPLICATIONS

This application is a U.S. National Phase Application filed under 35 U.S.C. § 371, based on International PCT Patent Application No. PCT/US2018/065680, filed Dec. 14, 2018. The entire contents of this application is incorporated herein by reference in its entirety.

BACKGROUND OF THE INVENTION

1. Field of the Invention

The present disclosure relates to downhole cementing, and more particularly to dump bailers for delivering cement downhole.

2. Description of Related Art

Dump bailers have been widely used to dump cement slurry at the setting depth from a plug downhole, e.g. in oil/gas wells, to create a barrier or zonal isolation for many applications in well intervention and/or plug and abandonment operations. The wireline or slickline conveyance method is used to run the dump bailer. While running in the well, many challenges occur due to the complex conditions of the typical well. Wells with large deviations can cause the dump bailer to lodge or get stuck, leaving cement slurry hardening in the bailer. Increasing bailer size can reduce the number of runs needed, but may increase frictional heating. The additional heat increases the chance for the slurry hardening within the bailer before being delivered to the well. These and other factors can lead to unsuccessful placement of the cement plug, i.e. failure to dump, which may necessitate the delay and expense of remedial measures.

The conventional techniques have been considered satisfactory for their intended purpose. However, there is an ever present need for improved dump bailers. This disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
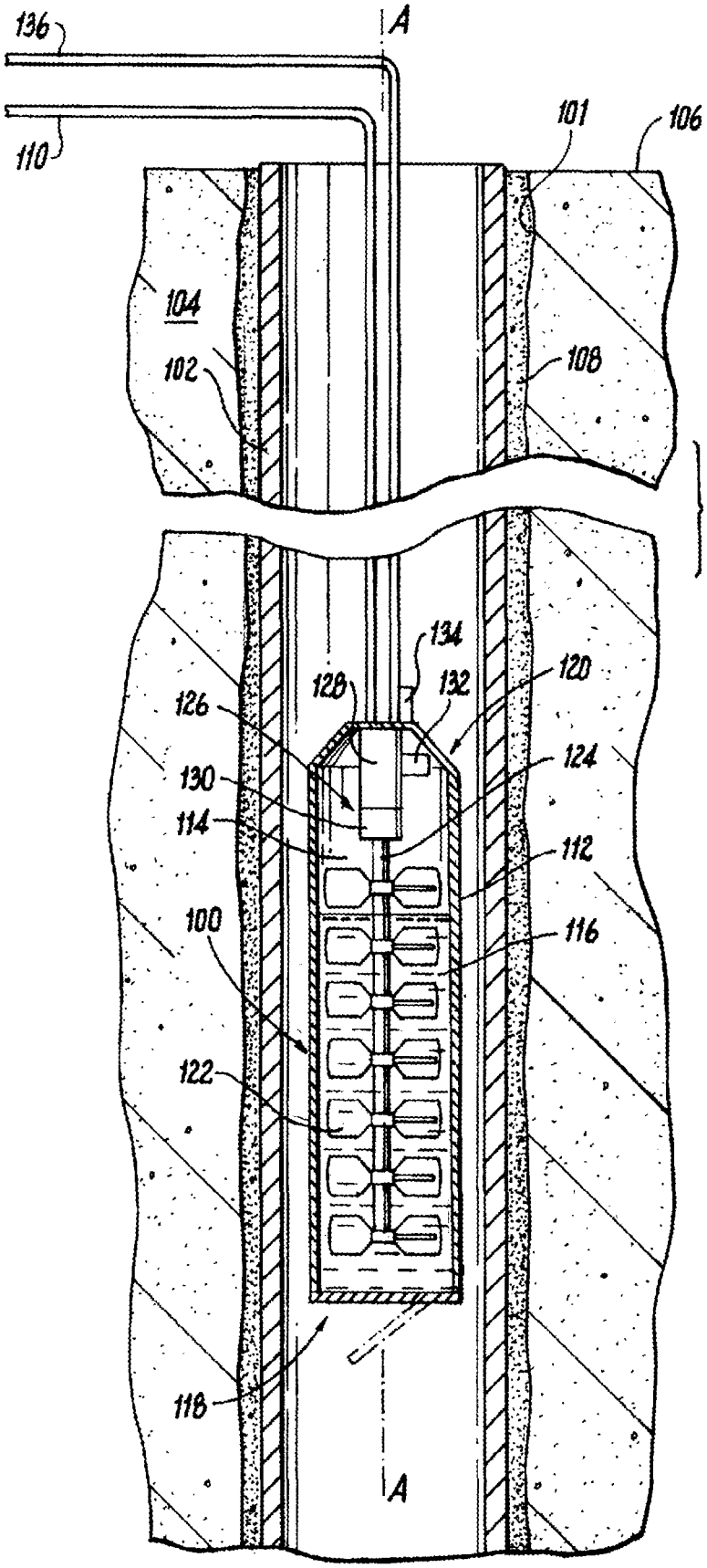
FIG. 1 is a schematic cross-sectional side elevation view of an exemplary embodiment of a dump bailer constructed in accordance with the present disclosure, showing the dump bailer running in a wellbore with a slickline and wireline.

Reference will now be made to the drawings wherein like reference numerals identify similar structural features or aspects of the subject disclosure. For purposes of explanation and illustration, and not limitation, a partial view of an exemplary embodiment of a dump bailer in accordance with the disclosure is shown in FIG. 1 and is designated generally by reference character 100. Other embodiments of dump bailers in accordance with the disclosure, or aspects thereof, are provided in FIGS. 2-5, as will be described. The systems and methods described herein can be used to extend running time for dump bailers when delivering cement slurry downhole, even if for example, if the dump bailer becomes lodged or stuck during the run.

A well casing 102, e.g., a string of individual well casing members extends downhole in a well bore 101 in an earth formation 104 from a surface 106, with an annulus 108 defined between the well casing 102 and the earth formation 104. The dump bailer 100 can be run down hole inside the well casing 102 using a slick line 110. Those skilled in the art will readily appreciate that a dump bailer in accordance with any embodiment of this disclosure can also run down a well bore 101 without a well casing 102 or where the well casing extends only part of the depth of the well bore 101 if needed. The dump bailer 100 includes a bailer body 112 defining an interior space 114 for conveying cement slurry 116 downhole. A dump release mechanism 118 is operatively connected to the bailer body 112 for releasing cement slurry 116 from the interior space 114. The dump release mechanism 118 is shown schematically in FIG. 1 in the closed position for retaining the cement slurry 116 in the interior space 114, and the open position for releasing or dumping the cement slurry 116 is indicated with broken lines. An agitator 120 is operatively connected to the bailer body 112 for agitating cement slurry 116 in the interior space 114.

The agitator 120 can include a plurality of paddles 122 mounted to a shaft 124 extending in an axial direction along axis A for rotation within the interior space 114. The agitator 120 can include a rotary mechanism 126 operatively connected to the paddles 122 to drive the paddles 122 rotationally within the interior space 114. The rotary mechanism 126 includes a motor 128. The motor 128 connects to the paddle through a gear box 130, which in turn connects to the shaft 124. The motor can be configured to be powered a battery 132 mounted to the bailer body 112 and/or by a wireline connection 134 operatively connected to the bailer body 112 for powering the motor from the surface 106 via the wireline 136.

Figure 2:
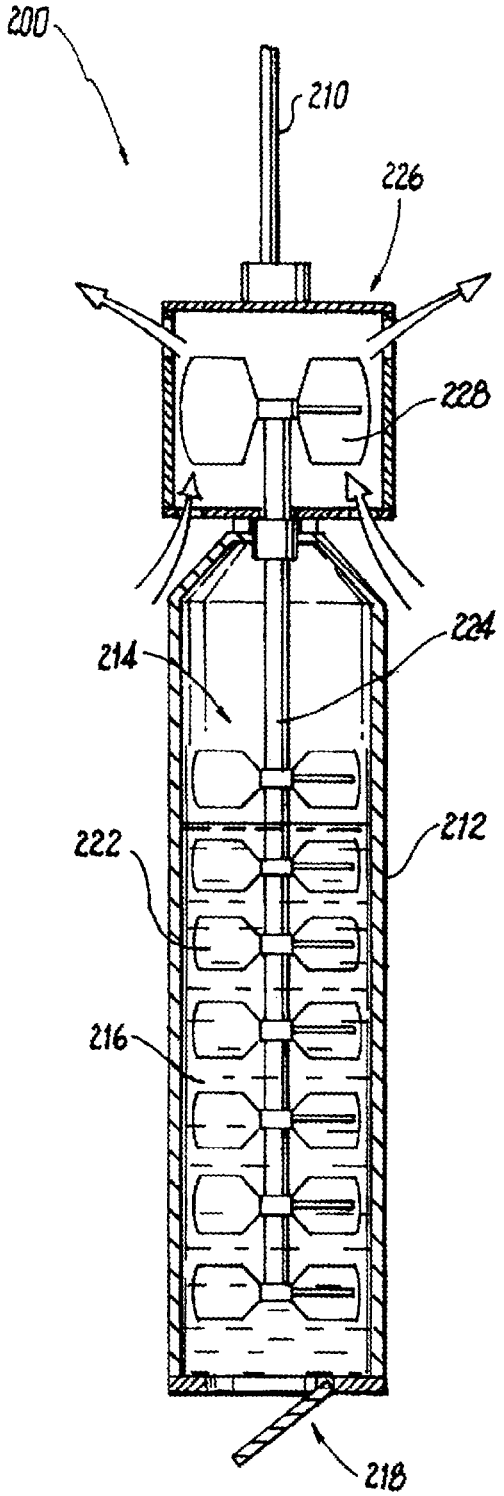
FIG. 2 is a schematic cross-sectional side elevation view of another exemplary embodiment of a dump bailer constructed in accordance with the present disclosure, showing a turbine for driving the paddles.

With reference now to FIG. 2, another exemplary dump bailer 200 is shown, including a bailer body 212, shaft 224, paddles 222, and dump mechanism 218 similar to those described above with respect to dump bailer 100. In FIG. 2, the dump mechanism is shown in the open position, with the closed position indicated schematically with broken lines. The rotary mechanism 226 includes a turbine 228 mounted to the bailer body 212 for being passively driven by well bore fluids passing over the bailer body 212 as indicated schematically in FIG. 2 by the flow arrows. The turbine 228 is operatively connected to the shaft 224 to rotate the paddles 222 within the interior space 214 to agitate the cement slurry 216. In dump bailer 200, a battery or wireline are not needed and the dump bailer 200 can be run downhole with only a slickline 210.

Figure 3:
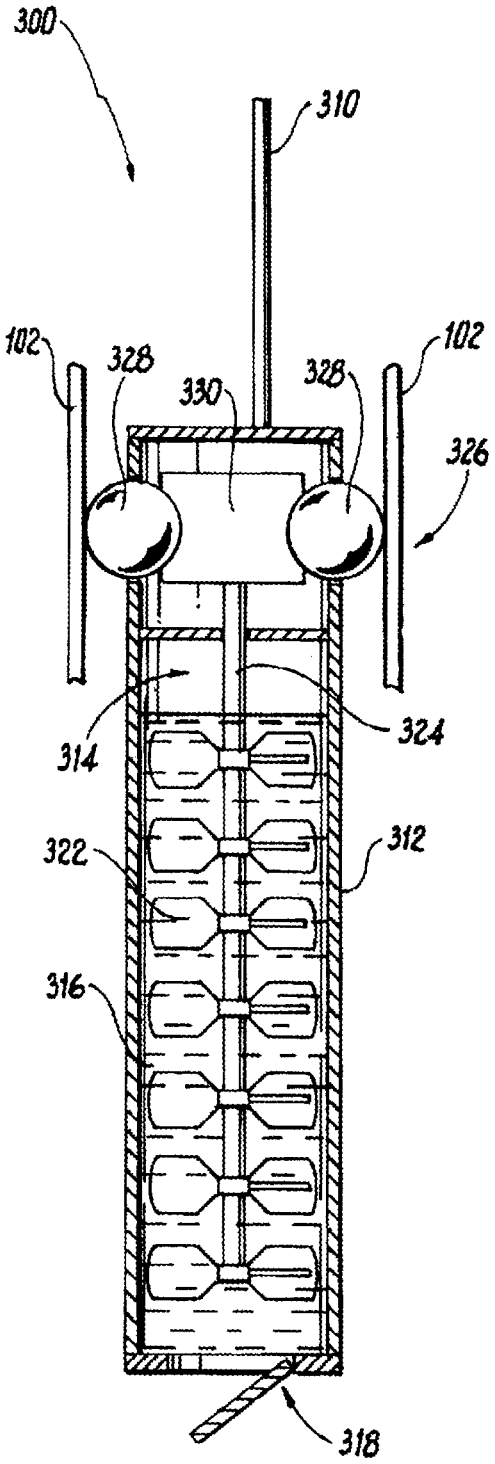
FIG. 3 is a schematic cross-sectional side elevation view of another exemplary embodiment of a dump bailer constructed in accordance with the present disclosure, showing a set of roller wheels for driving the paddles.

With reference now to FIG. 3, another exemplary dump bailer 300 is shown, including a bailer body 312, shaft 324, paddles 322, and dump mechanism 318 similar to those described above with respect to dump bailer 100. The bailer body 312 can be run down the well casing 102 with the slickline 310. The rotary mechanism 326 includes a set of one or more roller wheels 328 operatively connected to an exterior of the bailer body 312. The roller wheels 328 interface between the bailer body 312 and the well casing 102 (or other interior surface such as the surface of the earth formation 104 defined by the well bore 101, for example) to mitigate frictional heating of the bailer body 312, e.g. by keeping the bailer body 312 spaced apart from and aligned with the well casing 102. As the dump bailer 300 runs downhole, the motion causes the roller wheels 328 to rotate. The roller wheels 328 in turn are operatively connected to the shaft 324 through a gear train 330 to rotate the paddles 32 within the interior space 314 to agitate the cement slurry 316.

Figure 4:
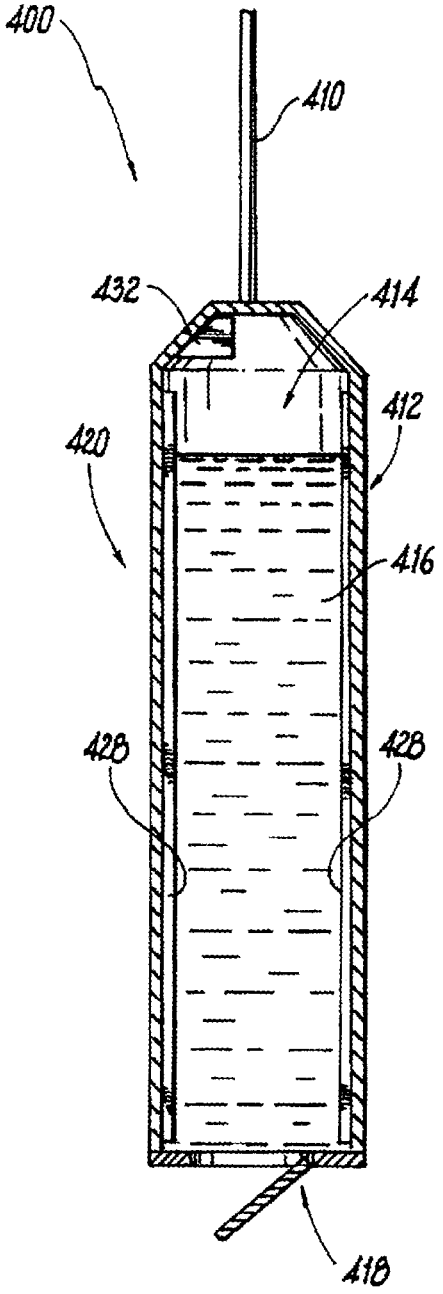
FIG. 4 is a schematic cross-sectional side elevation view of another exemplary embodiment of a dump bailer constructed in accordance with the present disclosure, showing a set of piezo strips for agitating cement slurry.

Referring now to FIG. 4, another exemplary dump bailer 400 is shown, including a bailer body 412 and dump mechanism 418 similar to those described above with respect to dump bailer 100. The bailer body 412 can be run down hole with the slickline 410. The agitator 420 includes a plurality of piezo strips 428 lining an interior surface of the bailer body 412. The piezo strips 428 can be powered by a battery 432 and/or a wireline (not labeled in FIG. 4, but see wireline 536 in FIG. 5) to vibrate to agitate the cement slurry 416 while it is in the interior space 414.

Figure 5:
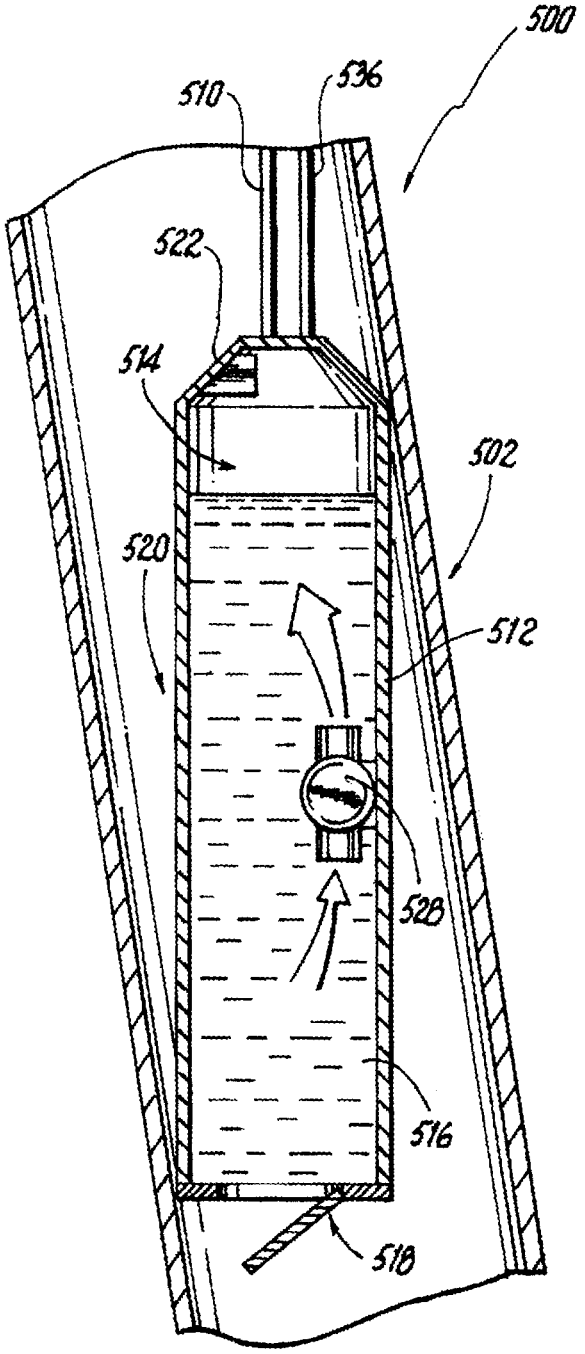
FIG. 5 is a schematic cross-sectional side elevation view of another exemplary embodiment of a dump bailer constructed in accordance with the present disclosure, showing a pump in fluid communication with the interior space for circulating cement slurry in the interior space.

Referring now to FIG. 5, another exemplary dump bailer 500 is shown, including a bailer body 512 and dump mechanism 518 similar to those described above with respect to dump bailer 100. The bailer body 512 can be run down hole with the slickline 510. The agitator 520 can include a pump 528 in fluid communication with the interior space 514 for circulating cement slurry 516 in the interior space 514 as indicate by the flow arrows in FIG. 5. Power for the pump can be provided by an operatively connected battery 522 and/or a wireline 536.

In general, in another aspect, the disclosed embodiments relate to a method of delivering cement slurry to a downhole position in a well bore. The method includes a running a bailer, e.g. bailer 100, 200, 300, 400, 500, downhole in a well bore, e.g. the well bore 101. Cement slurry, e.g., cement slurry 116, is housed within the bailer. The method includes agitating the cement slurry within the bailer and releasing the cement slurry from the bailer into the well bore.

In another aspect, agitating can include rotating a paddle, e.g. paddles 122, 222, 322, within the interior space. Rotating the paddle can include driving the paddle with a rotary mechanism as described above. In another aspect, agitating can include vibrating a plurality of piezo strips, e.g. piezo strips 428, lining an interior surface of the bailer body. It is also contemplated that agitating can include circulating cement slurry with a pump, e.g., pump 528 in fluid communication with the interior space.

In accordance with any of the foregoing embodiments, agitating can include agitating the cement slurry while the bailer is lodged or stuck in the well bore. For example, the dump bailer 500 is shown in FIG. 5 lodged in a deviation of the well casing 502, but those skilled in the art will readily appreciate that if there is no well casing, a dump bailer could similarly become lodged directly against the inner surface of the well bore 101 or any other applicable interior surface. Those skilled in the art will readily appreciate that dump bailers 100, 200, 400 can also agitate cement slurry if they become lodged during running downhole. This can prevent the cement slurry from setting inside the dump bailer while the dump bailer is extricated to continue running downhole to its intended destination. It is also contemplated that in accordance with any of the foregoing embodiments, releasing the cement slurry can include releasing a dump release mechanism, e.g., dump release mechanism 118, 218, 318, 418, 518 of the bailer.

Systems and techniques a disclosed herein can increase probability of successfully dumping fluid from a dump bailer, e.g. to form a cement plug in a well. They also can provide a way to control and adjust the setting of slurry based on the in-situ situation of the well. For example, systems and methods as disclosed herein can provide a way to control the acceleration of hydration reactions due to additional heat from friction heating. They can also provide additional time for dumping slurry which can be particularly advantageous if there are delays such as arising from the dump bailer becoming lodged or stuck in a well, without severely compromising the wait-on-cement (WOC) time. WOC time is the amount of time required to wait on the cement without any interruption to achieve sufficient strength. Since typical wireline and slickline tools have a maximum run-in-hole (RIH) speed, the dump time of the cement slurry limits traditionally limits the depth of well where the bailer can dump. But systems and methods as disclosed herein, by extending the time before cement slurry sets, can allow form greater range of depths at which cement can be dumped without compromising the strength development of the cement. These and other advantages can significantly increase the success of plug cementing operations and can improve the quality of this type of well service.

Accordingly, as set forth above, the embodiments disclosed herein may be implemented in a number of ways. For example, in general, in one aspect, the disclosed embodiments relate to a dump bailer. The dump bailer includes a bailer body defining an interior space for conveying cement slurry downhole. A dump release mechanism is operatively connected to the bailer body for releasing cement slurry from the interior space. An agitator is operatively connected to the bailer body for agitating cement slurry in the interior space.

In general, in another aspect, the disclosed embodiments relate to a method of delivering cement slurry to a downhole position in a well bore. The method includes a running a bailer downhole in a well bore, wherein cement slurry is housed within the bailer. The method includes agitating the cement slurry within the bailer and releasing the cement slurry from the bailer into the well bore.

In accordance with any of the foregoing embodiments, the agitator can include a paddle mounted for rotation within the interior space. The agitator can include a rotary mechanism operatively connected to the paddle to drive the paddle rotationally within the interior space. The rotary mechanism can include a motor operatively connected to rotate the paddle within the interior space. The motor can connect to the paddle through a gear box, and the motor can be configured to be powered by at least one of a battery mounted to the bailer body and/or by a wireline connection operatively connected to the bailer body. The rotary mechanism can include a turbine mounted to the bailer body for being passively driven by well bore fluids passing over the bailer body, wherein the turbine is operatively connected to rotate the paddle within the interior space. It is also contemplated that the rotary mechanism can include one or more roller wheels operatively connected to an exterior of the bailer body, wherein the one or more roller wheels are configured to interface between the bailer body and a well casing to mitigate frictional heating of the bailer body, and wherein the roller wheels are operatively connected to rotate the paddle within the interior space.

In another aspect, the agitator can include a plurality of piezo strips lining an interior surface of the bailer body. It is also contemplated that the agitator can include a pump in fluid communication with the interior space for circulating cement slurry in the interior space.

In another aspect, agitating can include rotating a paddle within the interior space. Rotating the paddle can include driving the paddle with a rotary mechanism. Driving the paddle can include using a motor operatively connected to rotate the paddle within the interior space. Using the motor can include rotating the paddle through a gear box, and wherein the motor is configured to be powered by at least one of a battery mounted to the bailer body and/or by a wireline connection operatively connected to the bailer body. It is also contemplated that driving the paddle with the rotary mechanism can include using a turbine mounted to the bailer body for being passively driven by well bore fluids passing over the bailer body, wherein the turbine is operatively connected to rotate the paddle within the interior space. Driving the paddle with the rotary mechanism can include using one or more roller wheels operatively connected to an exterior of the bailer body, wherein the one or more roller wheels are configured to interface between the bailer body and a well casing to mitigate frictional heating of the bailer body, wherein the roller wheels are operatively connected to rotate the paddle within the interior space.

In another aspect, agitating can include vibrating a plurality of piezo strips lining an interior surface of the bailer body. It is also contemplated that agitating can include circulating cement slurry with a pump in fluid communication with the interior space.

In accordance with any of the foregoing embodiments, agitating can include agitating the cement slurry while the bailer is lodged or stuck in the well bore. It is also contemplated that in accordance with any of the foregoing embodiments, releasing the cement slurry can include releasing a dump release mechanism of the bailer.

The methods and systems of the present disclosure, as described above and shown in the drawings, provide for dump bailers with superior properties including improved delivery of cement slurry to the desired location downhole, with extended running time for the dump bailer before the cement slurry sets. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A dump bailer comprising:

a bailer body defining an interior space for conveying cement slurry downhole;

a dump release mechanism operatively connected to the bailer body for releasing cement slurry from the interior space; and an agitator operatively connected to the bailer body for agitating cement slurry in the interior space, wherein the agitator includes a paddle mounted for rotation within the interior space, wherein the agitator includes a rotary mechanism operatively connected to the paddle to drive the paddle rotationally within the interior space, wherein the rotary mechanism includes a turbine mounted to the bailer body for being passively driven by well bore fluids passing over the bailer body, wherein the turbine is operatively connected to rotate the paddle within the interior space.

2. A dump bailer comprising:

a bailer body defining an interior space for conveying cement slurry downhole;

a dump release mechanism operatively connected to the bailer body for releasing cement slurry from the interior space; and an agitator operatively connected to the bailer body for agitating cement slurry in the interior space, wherein the agitator includes a paddle mounted for rotation within the interior space, wherein the agitator includes a rotary mechanism operatively connected to the paddle to drive the paddle rotationally within the interior space, wherein the rotary mechanism includes one or more roller wheels operatively connected to an exterior of the bailer body, wherein the one or more roller wheels are configured to interface between the bailer body and a well casing to mitigate frictional heating of the bailer body, wherein the roller wheels are operatively connected to rotate the paddle within the interior space.

3. A dump bailer comprising:

a bailer body defining an interior space for conveying cement slurry downhole;

a dump release mechanism operatively connected to the bailer body for releasing cement slurry from the interior space; and an agitator operatively connected to the bailer body for agitating cement slurry in the interior space, wherein the agitator includes a plurality of piezo strips lining an interior surface of the bailer body.

4. A method of delivering cement slurry to a downhole position in a well bore comprising:

running a bailer downhole in a well bore, wherein cement slurry is housed within the bailer;

agitating the cement slurry within the bailer; and releasing the cement slurry from the bailer into the well bore, wherein agitating includes rotating a paddle within the interior space, wherein rotating the paddle includes driving the paddle with a rotary mechanism, wherein driving the paddle with the rotary mechanism includes using a turbine mounted to the bailer body for being passively driven by well bore fluids passing over the bailer body, wherein the turbine is operatively connected to rotate the paddle within the interior space.

5. The method as recited in claim 4, wherein agitating includes agitating the cement slurry while the bailer is lodged or stuck in the well bore.

6. The method as recited in claim 4, wherein releasing the cement slurry includes releasing a dump release mechanism of the bailer.

7. A method of delivering cement slurry to a downhole position in a well bore comprising:

running a bailer downhole in a well bore, wherein cement slurry is housed within the bailer;

agitating the cement slurry within the bailer; and releasing the cement slurry from the bailer into the well bore, wherein agitating includes rotating a paddle within the interior space, wherein rotating the paddle includes driving the paddle with a rotary mechanism, wherein driving the paddle with the rotary mechanism includes using one or more roller wheels operatively connected to an exterior of the bailer body, wherein the one or more roller wheels are configured to interface between the bailer body and a well casing to mitigate frictional heating of the bailer body, wherein the roller wheels are operatively connected to rotate the paddle within the interior space.

8. The method as recited in claim 7, wherein agitating includes agitating the cement slurry while the bailer is lodged or stuck in the well bore.

9. The method as recited in claim 7, wherein releasing the cement slurry includes releasing a dump release mechanism of the bailer.

10. A method of delivering cement slurry to a downhole position in a well bore comprising:

running a bailer downhole in a well bore, wherein cement slurry is housed within the bailer;

agitating the cement slurry within the bailer; and releasing the cement slurry from the bailer into the well bore, wherein agitating includes vibrating a plurality of piezo strips lining an interior surface of the bailer body.

11. The method as recited in claim 10, wherein agitating includes agitating the cement slurry while the bailer is lodged or stuck in the well bore.

12. The method as recited in claim 10, wherein releasing the cement slurry includes releasing a dump release mechanism of the bailer.

* * * * *